US005311688A

United States Patent [19]

Aeschbacher et al.

[11] Patent Number: 5,311,688

[45] Date of Patent: May 17, 1994

[54] PIPEMARKER

[75] Inventors: Lori L. Aeschbacher, Whitefish Bay; Scott J. Collins; Gary J. Wirth, both of Milwaukee; George F. Jambor, Jackson, all of Wis.

[73] Assignee: Brady USA, Inc., Milwaukee, Wis.

[21] Appl. No.: 1,483

[22] Filed: Jan. 7, 1993

[51] Int. Cl.[5] ..... G09F 3/14

[52] U.S. Cl. ..... 40/665; 40/306; 40/316; 248/231; 248/221.4

[58] Field of Search ..... 40/306, 316, 665; 248/231, 221.4; 24/269, 71.2, 68 CD, 20 R, 20 TT, 69 ST; 292/256.63; 220/320

[56] References Cited

U.S. PATENT DOCUMENTS 1,486,850 3/1924 Avery et al. .
1,960,748 5/1934 Meunier .
2,188,710 1/1940 Giovanini et al. .
2,191,808 2/1940 Schramm .
2,641,817 6/1953 Brodheim ..... 24/269
3,491,470 1/1970 Geisinger .
4,246,712 1/1981 Vander Wall ..... 40/316
5,138,784 8/1992 Niwa .

*Primary Examiner*—Clifford D. Crowder
*Assistant Examiner*—Gloria Hale
*Attorney, Agent, or Firm*—Quarles & Brady

[57] ABSTRACT

A pipemarker consists of an elongated sign, which has a front face for bearing identifying information and a rear face with a bracket-receiving channel, and at least one bracket that can be attached to a pipe with strapping. The bracket includes a rachet for tightening the strapping and an outward projection containing a compression spring which snaps into the bracket-receiving channel of the sign.

7 Claims, 2 Drawing Sheets

FIG. 5
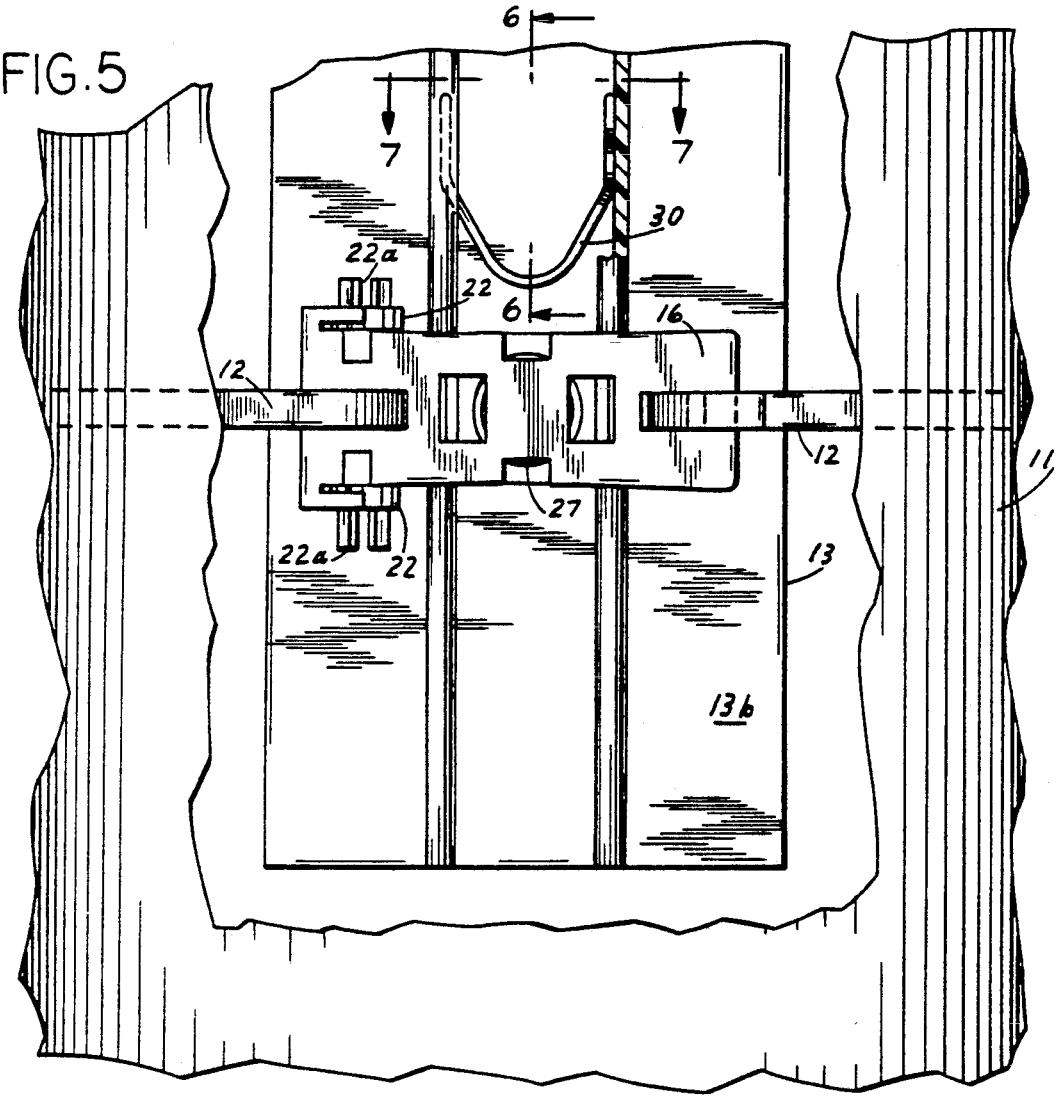
FIG. 6
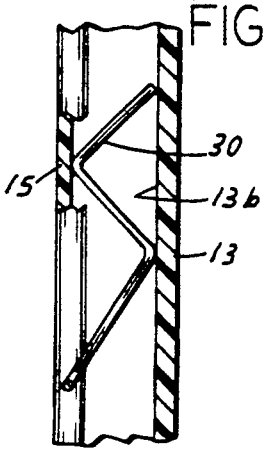
FIG. 7
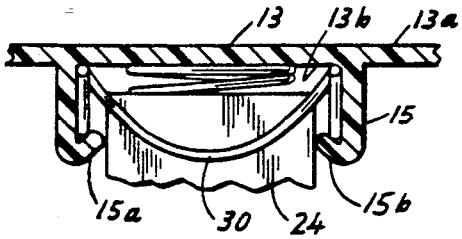
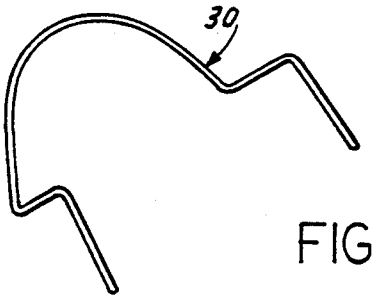
FIG. 8

PIPEMARKER

FIELD OF THE INVENTION

The present invention relates to a pipemarker, and more particularly to a pipemarker for providing information as to the contents and direction of flow through a pipe.

BACKGROUND OF THE INVENTION

The proper identification of pipes and their contents is highly desirable. Proper identification, in addition to increasing efficiency, can prevent industrial accidents and personal injuries by making readily available important information to workers and emergency response personnel.

Governmental units, both local and national, have adopted pipe marking standards designed to promote safety. The standards usually include marking the pipes with a specific color which indicates whether or not the fluid contained therein is hazardous, gaseous, or liquid. They also may require markings that show the normal direction of flow through the pipe. The standards are intended to ensure that critical information is readily available by a simple visual inspection.

Various approaches have been tried to satisfy the requirements of those standards. One approach has been to paint the pipes the appropriate color and to paint the required information in a contrasting color directly upon the pipes. However, that approach has not been completely successful because where the pipes are rusted or covered with grease, the paint doesn't stay on the pipes. Another approach has been to paint the pipes an appropriate color and to apply pressure sensitive adhesive labels bearing the desired information directly onto the pipes. However, if the pipe gets hot, or if the pipe is dirty, the labels may not stay in place even if the paint stays on the pipe.

The most promising approach has been to attach a sign to the pipe. The sign can either be of the appropriate color or it can bear a label of the appropriate color and any desired markings. The sign is usually secured to a pipe by tape or bands or straps that pass through slots in the sign and encircle the pipe. This type of pipemarker works quite well, however, there is still room for improvement because it can be difficult to install. Furthermore, it usually requires the use of custom tapes, bands or straps.

BRIEF SUMMARY OF THE INVENTION

It is an object of the present invention to disclose a novel pipemarker which is easy to install even on large diameter pipes and which uses commercially available flexible strapping.

It is a further object to disclose a novel bracket which can be installed upon a pipe with strapping and to which a rigid sign can be readily attached with common tools to form a pipemarker.

It is a still further object to disclose a kit for making a pipemarker which includes one or more brackets, strapping for attaching the brackets to a pipe and a sign which can be attached to the bracket(s).

The pipemarker of the present invention comprises a sign having a front face for bearing an appropriate color and/or lettering and a back face that includes a bracket. receiving channel and at least one bracket that can be readily attached to a pipe with flexible strapping.

In a preferred embodiment, the bracket has means for anchoring one end of a flexible strap and a rachet into which the other end of the strap can be inserted after it has been placed circumferentially about a pipe. The bracket is secured to a pipe by turning the rachet to tighten the strap. Once one or more brackets are in place the sign body can be attached by positioning the bracket(s) within the bracket-receiving channel.

The aforementioned objects and further advantages are obtained by the practice of the present invention.

BRIEF DESCRIPTION OF THE DRAWINGS

FIG. 5 is a partial view of the pipe side of the pipemarker with the pipe broken away so the bracket can be seen;

FIG. 6 is a view taken along lines 6—6 in FIG. 5;

FIG. 7 is a view taken along lines 7—7 in FIG. 5; and

FIG. 8 is a perspective view of the clip seen in FIGS. 5-7.

DESCRIPTION OF THE PREFERRED EMBODIMENT

Figure 1:
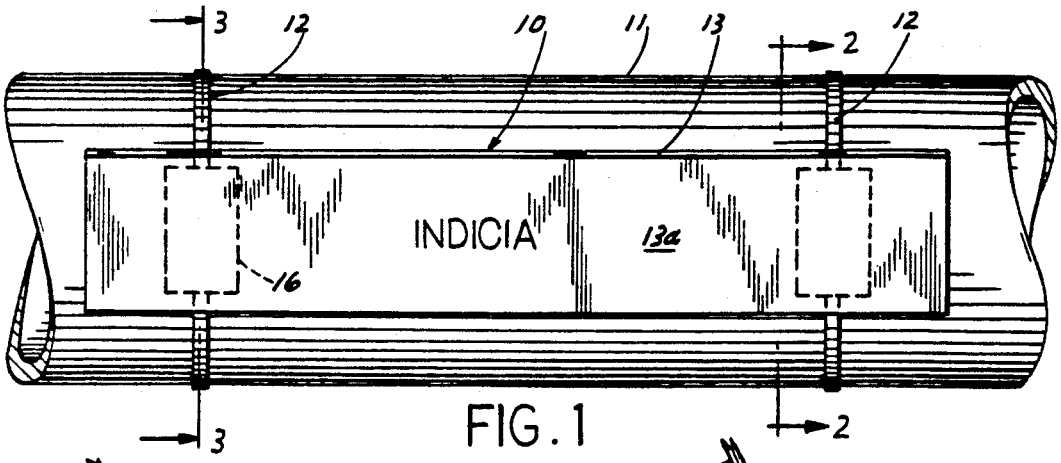
FIG. 1 is a plan view showing a pipemarker of the present invention attached with straps to a pipe.

In the embodiment of the present invention seen in FIG. 1, a pipemarker 10 is shown secured to a pipe 11 with a pair of straps 12.

As seen best in FIG. 1 the pipemarker 10 has an elongated, relatively rigid, sign 13 which has a front face 13*a*, which may be of an appropriate color or which bears appropriately colored labels (not shown).

Figure 2:
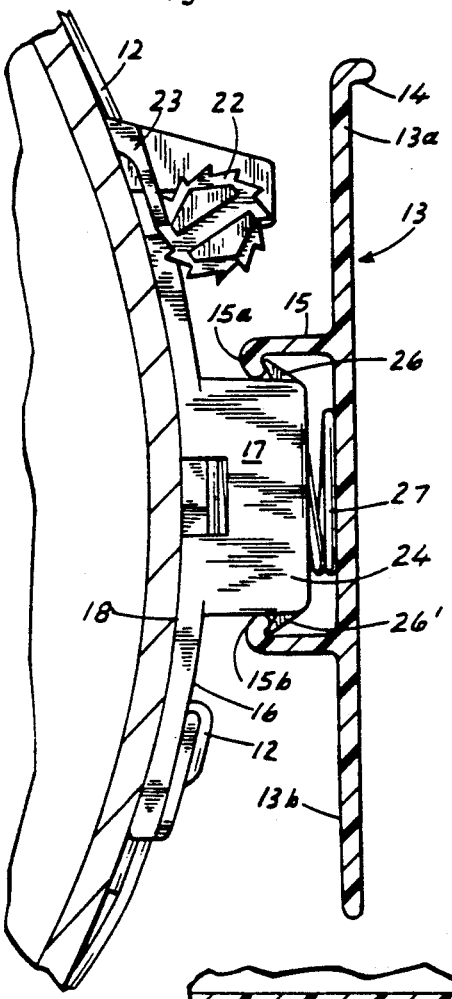
FIG. 2 is a view taken along lines 2—2 in FIG. 1.
Figure 3:
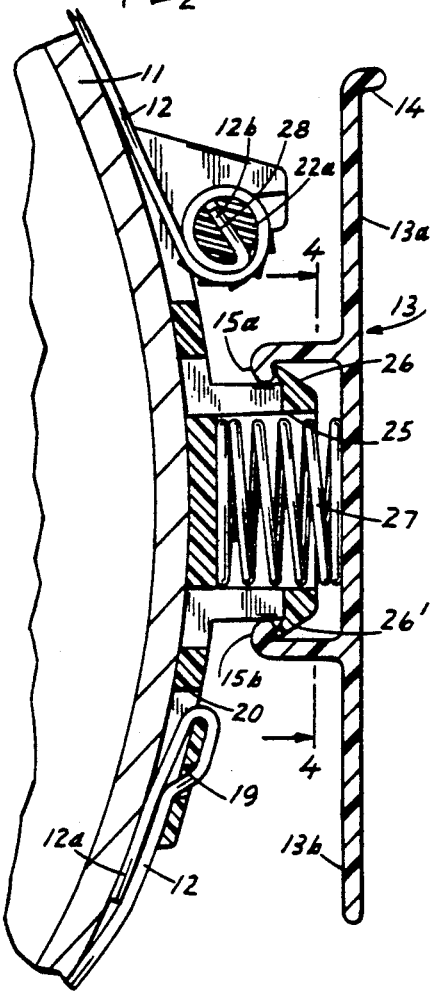
FIG. 3 is a view taken along lines 3—3 in FIG. 1.

Turning to FIGS. 2 and 3, it can be seen that the front face 13*a* of the sign 13 is generally flat, except for a small outwardly extending lip 14 at the top which helps keep debris, dirt or spills off the face 13*a*. The lip 14 also serves as an alignment aid for label application. The back face 13*b* of the sign body 13 includes a generally U-shaped channel 15. The channel 15 has a pair of inwardly directed flanges 15*a* and 15*b* which cooperate with a bracket 16 to hold the sign body 13 in proper position on the pipe 11.

The bracket(s) 16 are identical and can be seen in dotted lines in FIG. 1. Referring to FIGS. 2 and 3, it can be seen that the bracket 16 has a molded body 17 having a rear face 18 which is curved so that it generally follows the circumference of the pipe 11.

The body 17 of the bracket 16 is provided near the bottom with a pair of strap anchoring slots 19 and 20 and the front face 21 is provided at the top with a rachet wheel 22 and pawl 23, as seen only in FIG. 2. The front face 21 of the bracket 16 also is provided with a circular projection 24 having a central recess 25. The projection 24 has a pair of outwardly extending ears 26, 26'. When the projection 24 is in the channel 15 of the sign 13, the ears 26, 26' cooperate with the flanges 15*a*, 15*b* to keep the projection 24 in the channel 15 and a compression spring 27 in the recess 25 exerts a pressure on the back face 13*b* of the sign 13 to keep the sign 13 in the proper position.

The bracket 16 is secured to the pipe 11 by anchoring one end 12*a* of a strap 12 by passing it first through the slot 19, then through the slot 20 and then bending it back towards the main body of the strap 12, as seen best in FIG. 3. The strap 12 is then wrapped circumferentially around the pipe 11, and the free other end 12*b* inserted in a slot 28 in a shaft 22*a* of the rachet wheel 22, as seen best in FIG. 3. To secure the bracket 16 to the pipe 11, the rachet wheel 22 is then turned to take up the excess length of strap 12 until the strap 12 is tight. Depending upon the length of the sign body 13 one or more brackets 16 may be required. Once the bracket(s) 16 are in place, the pipemarker 10 can be assembled by snapping the sign 13 to the bracket(s) 16 already in place by positioning the channel 15 of the sign 13 directly over the projection(s) 24 and then pushing the sign 13 back toward the pipe 11 until the flanges 15*a* and 15*b* pass over the ears 26 and 26' of the projection 24. The ears 26 and 26', the flanges 15*a* and 15*b* and the compression spring 27 then cooperate to keep the sign 13 in place and the pipemarker 10 assembled.

In a preferred embodiment, the sign 13 is a pultruded fiberglass reinforced polyester, the bracket 16 is molded of nylon material, and the straps 12 are made of stainless steel. However, the various components of the pipemarker 10 can be made of any material which is suitable for use under the intended conditions.

Figure 4:
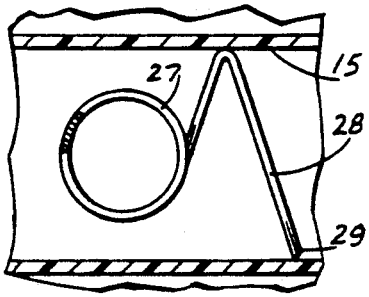
FIG. 4 is an enlarged view taken along lines 4—4 in FIG. 3.

In another embodiment, the compression spring 27 has a leg 28 (seen only in FIG. 4) which projects tangentially outwardly from the coiled body of spring 27 to engage one wall of the channel 15 and which is bent back so that the tip 29 engages the other wall of the channel 15 so as to prevent the sign from slipping or moving once the pipemarker 10 is fully assembled.

In FIGS. 5 to 8 a clip 30 is shown which engages the walls of the channel 15 to prevent the sign 13 from moving relative to the bracket(s) 16 even when the pipemarker 10 is attached to a vertical pipe 11.

It will be apparent to those skilled in the art that the pipemarker of the present invention offers several advantages over the prior art pipemarkers. One of the most important advantages is that with the pipemarker of the present invention the brackets can be attached to a pipe first and then the sign body simply snapped into place. Another advantage is that the same brackets can be used for signs of different lengths.

It also will be apparent to those skilled in the ar that a number of changes and modifications can be made without departing from the spirit and scope of the invention. Therefore, it is intended that the invention be limited only by the scope of the claims.

We claim:

1. A pipemarker comprising (a) an elongated sign body having a flat front face and a back face with a bracket-receiving channel; (b) a bracket for attachment to a pipe; and (c) an elongated strap for attaching the bracket to a pipe; said bracket having means for anchoring one end of the strap and rachet means for receiving the other end of the strap after the strap has been placed circumferentially about a pipe and for tightening the strap to attach the bracket to a pipe whereupon the sign body can be attached to the pipe by positioning the bracket in the bracket-receiving channel of the sign body.

2. A pipemarker of claim 1 in which the bracket has a pipe-conforming back and a front with an upward projection that fits in and is retained within the bracket-receiving channel on the back of the sign body.

3. A pipemarker of claim 2 in which the outward projection includes a recess in which a compression spring is positioned.

4. A pipemarker of claim 3 in which the compression spring has a leg which extends tangentially outwardly so that when the pipemarker is assembled the leg frictionally engages the sign body.

5. A pipemarker of claim 1 in which the bracket-receiving channel is a U-shaped member having walls and there is a clip which engages the walls of the channel and prevents the sign body from moving relative to the bracket.

6. A package containing a kit for assembling a pipemarker on a pipe, said kit comprising at least one sign body having a flat front face and a back with a bracket-receiving channel; at least one bracket with a rachet; and at least one strap for attaching the bracket to a pipe by encircling the pipe with the strap and tightening the strap by use of the rachet so that the sign body can be attached to the bracket by positioning the bracket in the bracket-receiving channel of the sign body.

7. A pipemarker comprising (a) an elongated sign body having a flat front face and a back face with a bracket-receiving channel; (b) a bracket for attachment to a pipe; and (c) a strap for circumferentially encircling a pipe; said bracket having means for anchoring one end of the strap and means for receiving the other end of the strap after the strap has been placed circumferentially about a pipe and so that the sign body can be attached to the bracket on the pipe by positioning the bracket in the bracket-receiving channel of the sign body.

* * * * *